US008916326B2

(12) United States Patent
Kung

(10) Patent No.: US 8,916,326 B2
(45) Date of Patent: Dec. 23, 2014

(54) THERMAL IMAGE RECEIVER ELEMENTS HAVING RELEASE AGENTS

(71) Applicant: Kodak Alaris Inc., Rochester, NY (US)

(72) Inventor: Teh-Ming Kung, Rochester, NY (US)

(73) Assignee: Kodak Alaris Inc., Rochester, NY (US)

( * ) Notice: Subject to any disclaimer, the term of this patent is extended or adjusted under 35 U.S.C. 154(b) by 0 days.

(21) Appl. No.: 14/181,240

(22) Filed: Feb. 14, 2014

(65) Prior Publication Data

US 2014/0192129 A1 Jul. 10, 2014

Related U.S. Application Data

(63) Continuation of application No. 13/491,928, filed on Jun. 8, 2012, now Pat. No. 8,673,535.

(51) Int. Cl.

| | |
|---|---|
| ***G03C 8/00*** | (2006.01) |
| ***B41M 3/12*** | (2006.01) |
| ***B41M 5/20*** | (2006.01) |
| ***B41M 5/24*** | (2006.01) |
| ***B41M 5/40*** | (2006.01) |

(52) U.S. Cl.
USPC ..... 430/200; 430/199; 430/202; 427/152; 428/32.39; 503/227

(58) Field of Classification Search
USPC ..... 430/270.1, 199, 200, 202, 203; 503/227; 428/32.39; 427/152
See application file for complete search history.

*Primary Examiner* — Amanda C. Walke
(74) *Attorney, Agent, or Firm* — Hogan Lovells US LLP

(57) ABSTRACT

A thermal image receiver element dry image receiving layer has a $T_g$ of at least 25° C. and is the outermost layer. The dry image receiving layer has a dry thickness of at least 0.5 μm and up to and including 5 μm. It comprises a water-dispersible release agent and a polymer binder matrix that consists essentially of: (1) a water-dispersible acrylic polymer comprising chemically reacted or chemically non-reacted hydroxyl, phospho, phosphonate, sulfo, sulfonate, carboxy, or carboxylate groups, and (2) a water-dispersible polyester that has a $T_g$ of 30° C. or less. The water-dispersible acrylic polymer is present in an amount of at least 55 weight % and at a dry ratio to the water-dispersible polyester of at least 1:1. The thermal image receiver element can be used to prepare thermal dye images after thermal transfer from a thermal donor element.

14 Claims, No Drawings

THERMAL IMAGE RECEIVER ELEMENTS HAVING RELEASE AGENTS

CROSS-REFERENCES TO RELATED APPLICATIONS

This application is a continuation of and claims priority to U.S. application Ser. No. 13/491,928, filed Jun. 8, 2012, which is hereby incorporated by reference in its entirety.

FIELD OF THE INVENTION

This invention relates to a thermal image receiver element that has an aqueous-based image receiving layer. This invention also relates to a method for making this thermal image receiver element as well as method for using it to provide a dye image by thermal transfer from a donor element.

BACKGROUND OF THE INVENTION

In recent years, thermal transfer systems have been developed to obtain prints from pictures that have been generated from a camera or scanning device. According to one way of obtaining such prints, an electronic picture is first subjected to color separation by color filters. The respective color-separated images are then converted into electrical signals. These signals are then transmitted to a thermal printer. To obtain the print, a cyan, magenta or yellow dye donor element is placed face-to-face with a thermal image receiver element. The two are then inserted between a thermal printing head and a platen roller. A line-type thermal printing head is used to apply heat from the back of the dye-donor sheet. The thermal printing head has many heating elements and is heated sequentially in response to one of the cyan, magenta or yellow signals. The process is then repeated for the other colors. A color hard copy is thus obtained which corresponds to the original picture viewed on a screen.

Various approaches have been suggested for providing a thermal dye receiving layer. Solvent coating of the dye image receiving layer formulation is a common approach. However, the use of solvents to coat these formulations brings with it various problems including expense, environmental hazards and waste concerns, and hazardous manufacturing processes. Special precautions are required to manage these problems. For example, organic solvent coated formulations and methods are described in U.S. Pat. No. 5,356,859 (Lum et al.).

Another approach involves hot-melt extrusion of the dye image receiving layer formulation onto a support. Multiple layers can be co-extruded in the preparation of the thermal image receiver element. Such methods are highly effective to prepare useful thermal image receiver elements but they restrict the type of materials that can be incorporated into the dye image receiving layer due to the high temperatures used for the extrusion process. U.S. Pat. No. 7,993,559 (Dontula et al.) and U.S. Patent Application Publication 2010/0330306 (Dontula et al.) describe imaging elements having multiple extruded layers included extruded compliant and antistatic subbing layers. U.S. Patent Application Publication 2008/0220190 (Majumdar et al.) describes image recording elements comprising a support having thereon an aqueous subbing layer and an extruded dye receiving layer. In addition, U.S. Patent Application Publications 2011/0091667 (Majumdar et al.) and 2010/0330306 (Dontula et al.) describe thermal dye transfer receiver elements that include an extruded compliant layer and an antistatic layer adhering it to an image receiving layer.

Yet another approach is to use aqueous coating formulations to prepare the dye image receiving layers. Such formulations typically include a water-soluble or water-dispersible polymer as the binder matrix. Some efforts to do make such formulations are described for example U.S. Patent Application Publications 2011/0027505 (Majumdar et al.) and 2011/0117299 (Kung et al.).

Although aqueous coating methods and formulations are desired for the noted reasons, aqueous-coated dye image receiving layers can exhibit problems in typical customer printing environments where high speed printing requires a smooth separation of dye donor element and the thermal image receiver element with no sticking between the contacting surfaces of the two elements. Printing such images in high humidity environments can be particularly troublesome for sticking with aqueous-coated dye image receiver layers. Moreover, such thermal image receiver elements are often deficient in providing adequate dye density in the thermally formed images. Aqueous-coated layers can also fall apart when contacted with water.

The industry has aggressively approached these problems with various proposed solutions that are described in the literature. For example, U.S. Patent Application Publication 2009/0061124 (Koide et al.) describes the use of various latex polymers in dye image receiving layers, which latex polymers are generally prepared at least in part from vinyl chloride. Alternatively, U.S. Pat. No. 7,820,359 (Yoshitani et al.) describes the use of latex polymers in dye image receiving layers, which latex polymers are derived from specific monomers having alkyleneoxy side chains and either an unsaturated nitrile, styrene, or styrene derivative.

Despite all of the known approaches to the various problems associated with the use of aqueous coated dye image receiving layer formulations, there continues to be a need to improve the resistance of such formulations (and the dried layers obtained therefrom) to changes in relative humidity so that the resulting images are consistent and exhibit sufficient density, no matter the relative humidity in which the thermal dye transfer elements are stored or used. There is also a need to reduce any potential for sticking of the coated image receiving layer and thermal donor elements after imaging. Such sticking can be caused by a number of conditions including high humidity.

SUMMARY OF THE INVENTION

This invention provides a thermal image receiver element comprising a support, and having on at least one side of the support:

a dry image receiving layer having a $T_g$ of at least 25° C., which dry image receiving layer is the outermost layer of the thermal image receiver element, has a dry thickness of at least 05 μm and up to and including 5 μm, and comprises a water-dispersible release agent and a polymer binder matrix that consists essentially of:

(1) a water-dispersible acrylic polymer comprising chemically reacted or chemically non-reacted hydroxyl, phospho, phosphonate, sulfo, sulfonate, carboxyl, or carboxylate groups, and (2) a water-dispersible polyester that has a $T_g$ of 30° C. or less, wherein the water-dispersible acrylic polymer is present in an amount of at least 55 weight % of the total dry image receiving layer weight.

In some embodiments of this invention, a thermal image receiver element comprises a support, and having one or both of opposing sides of the support:

a dry image receiving layer having a $T_g$ of at least 35° C. and up to and including 60° C., which dry image receiving layer is the outermost layer of the thermal image receiver element, has a dry thickness of at least 1 μm and up to and including 3 μm, and comprises water-dispersible release agent that is a modified polysiloxane, and a polymer binder matrix that consists essentially of:

(1) a water-dispersible acrylic polymer comprising chemically reacted or chemically non-reacted carboxy or carboxylate groups, wherein the water-dispersible acrylic polymer comprises recurring units derived from: (a) one or more ethylenically unsaturated polymerizable acrylates or methacrylates comprising acrylic alkyl ester, cycloalkyl ester, or aryl ester groups having at least 4 carbon atoms, (b) one or more carboxy-containing or carboxylate salt-containing ethylenically unsaturated polymerizable acrylate or methacrylate, and (c) optionally styrene or a styrene derivative, and wherein the (a) recurring units represent at least 20 mol % and up to and including 99 mol % of the total recurring units, and the (b) recurring units represent at least 1 mol % and up to and including 10 mol %, and (2) a water-dispersible, film-forming polyester that has a $T_g$ of at least 0° C. and up to and including 20° C., which water-dispersible, film-forming polyester having water-dispersibility groups, wherein the water-dispersible acrylic polymer is present in an amount of at least 60 weight % and up to and including 80 weight % of the total dry image receiving layer weight, and is present in the polymer binder matrix at a dry ratio to the water-dispersible polyester of at least 2:1 and up to and including 4:1, and the water-dispersible release agent is a polysilicone that is modified with amino side chains or terminal groups, and is present in an amount of at least 1 weight % and up to and including 5 weight %, based on the total dry image receiving layer weight.

This invention also provides an imaging assembly comprising the thermal image receiver element of any embodiments of this invention, in thermal association with a thermal donor element.

Further, a method for making the thermal image receiver element of any embodiments of this invention, comprises:

applying an aqueous image receiving layer formulation to one or both of the opposing sides of a support, the aqueous image receiving layer formulation comprising a water-dispersible release agent and a polymer binder composition consisting essentially of:

(1) a water-dispersible acrylic polymer comprising chemically reacted or chemically non-reacted hydroxyl, phospho, phosphonate, sulfo, sulfonate, carboxy, or carboxylate groups, and (2) a water-dispersible polyester that has a $T_g$ of 30° C. or less, wherein the water-dispersible acrylic polymer is present in an amount of at least 55 weight % of the resulting total dry image receiving layer weight, and is present in the polymeric binder matrix at a dry ratio to the water-dispersible polyester of at least 1:1 to and including 6:1, and drying the aqueous image receiving layer formulation to form a dry image receiving layer on one or both opposing sides of the support.

In addition, a method for making a thermal image, comprises:

imagewise transferring a clear polymeric film, one or more a dye images, or both a clear polymeric film and one or more dye images, from a thermal donor element to the image receiving layer of the dry thermal image receiving element of any embodiment of this invention.

A unique combination of polymers is applied in an aqueous formulation to prepare an image receiving layer in thermal image receiver elements that have reduced sensitivity of relative humidity. This combination of polymers has two essential types of polymers: (1) a water-dispersible acrylic polymer as defined herein, and (2) a water-dispersible polyester that has a $T_g$ of 30° C. or less. It has been found that the thermal image receiver elements of this invention exhibit reduced thermal print density variation due to changes in relative humidity. These advantages are not achieved by using only the (1) or (2) class of polymers alone.

In addition, combining these particular polymers with water-dispersible release agents provides reduced sticking between the thermal image receiver element and thermal donor elements during and after thermal imaging.

DETAILED DESCRIPTION OF THE INVENTION

Definitions

As used herein to define various components of the compositions, formulations, and layers described herein, unless otherwise indicated, the singular forms "a", "an", and "the" are intended to include one or more of the components (that is, including plurality referents).

Each term that is not explicitly defined in the present application is to be understood to have a meaning that is commonly accepted by those skilled in the art. If the construction of a term would render it meaningless or essentially meaningless in its context, the term's definition should be taken from a standard dictionary.

The use of numerical values in the various ranges specified herein, unless otherwise expressly indicated otherwise, are considered to be approximations as though the minimum and maximum values within the stated ranges were both preceded by the word "about". In this manner, slight variations above and below the stated ranges can be used to achieve substantially the same results as the values within the ranges. In addition, the disclosure of these ranges is intended as a continuous range including every value between the minimum and maximum values.

Unless otherwise indicated, the terms "thermal image receiver element", and "receiver element" are used interchangeably to refer to embodiments of the present invention.

The term "duplex" is used to refer to embodiments of the present invention in which each of the opposing sides of the substrate (defined below) has a dry image receiving layer (defined below) and therefore each side is capable of forming a thermal image (clear polymeric film or dye image), although it is not required in the method of this invention that a thermal image always be formed on both sides of the substrate. A "duplex" element can also be known as a "dual-sided" element.

Glass transition temperatures ($T_g$) can be determined using Differential Scanning calorimetry (DSC) and known procedures for example wherein differential power input is monitored for the sample composition and a reference as they are both heated at a constant rate and maintained at the same temperature. The differential power input can be plotted as a function of the temperature and the temperature at which the plot undergoes a sharp slope change is generally assigned as the $T_g$ of the sample polymer or dry image receiving layer composition.

Unless otherwise indicated, % solids or weight % are stated in reference to the total dry weight of a specific composition or layer.

The term "thermal donor element" is used to refer to an element (defined below) that can be used to thermally transfer a dye, ink, clear film, or metal. It is not necessary that each thermal donor element transfer only a dye or ink.

The term "thermal association" is used to refer to two different elements that are disposed in a relationship that allows thermal transfer of a dye, metal, or thin polymer film. Such a relationship generally requires intimate physical contact of the two elements while they are being heated.

The term "aqueous-coated" is used to refer to a layer that is applied or coated out of an aqueous coating formulation.

Unless otherwise indicated, the terms "polymer" and "resin" mean the same thing. Unless otherwise indicated, the term "acrylic polymer" is meant in encompass both homopolymers having the same recurring unit along the organic backbone, as well as copolymers having two or more different recurring units along the backbone.

The term "ethylenically unsaturated polymerizable monomer" refers to an organic compound that has one or more ethylenically unsaturated polymerizable groups (such as vinyl groups) that can be polymerized to provide an organic backbone chain of carbon atoms, and optionally various side chains attached to the organic backbone. The polymerized product of a particular ethylenically unsaturated polymerizable monomer, within the organic backbone, is called a "recurring unit". The various recurring units in the water-dispersible acrylic polymers used in the practice of this invention are distributed along the backbone of a given polymer in a random fashion, although blocks of common recurring units can be found but are not purposely formed along the organic backbone.

The terms "water-dispersible" and "water-dispersibility", when used in reference to the acrylic polymers and polyesters used in the practice of this invention, refer to the property in which these polymers are generally dispersed in an aqueous media during their manufacture or coating onto a support. They mean that the acrylic polymers and polyesters are generally supplied and used in the form of aqueous dispersions. They are not soluble in the aqueous media but they do not readily settle within the aqueous media. These terms do not refer to the acrylic polymers and polyesters, once coated and dried, as being re-dispersible in an aqueous medium. Rather, when such acrylic polymers and polyesters are dried on a support, they generally stay intact when contacted with water or aqueous solutions.

The term "non-voided" is used to refer to a layer or support being devoid of added solid or liquid matter or voids containing a gas.

The term "voided" is used to refer to a layer or support comprising microvoided polymers and microporous materials that are known in the art.

Thermal Image Receiver Elements

The thermal image receiver elements comprise a dry image receiving layer on one or both (opposing) sides of the support (described below). The dry image receiving layer is the outermost layer so that transfer of a dye, clear film, or metal can occur. One or more intermediate layers (described below) can be located between the dry image receiving layer and the support.

Image Receiving Layer:

The image receiving layer is the outermost layer in the thermal image receiver elements and generally has a $T_g$ of at least 25° C. and up to and including 70° C. or typically at least 35° C. and up to and including 70° C., or even at least 35° C. and up to and including 60° C. The dry image receiving layer $T_g$ is measured as described above with DSC by evaluating the dry image receiving layer formulation containing the required polymers (1) and (2) described below and any optional components, which is designed for a particular thermal image receiver element.

The dry image receiving layer has a dry thickness of at least 0.5 μm and up to and including 5 μm, and typically at least 1 μm and up to and including 3 μm. This dry thickness is an average value measured over at least 10 places in an appropriate electron scanning micrograph or other appropriate means and it is possible that there can be some places in the layer that exceeds the noted average dry thickness.

The dry image receiving layer comprises a polymer binder matrix that consists essentially of:

(1) One or more water-dispersible acrylic polymers, each comprising chemically reacted or chemically non-reacted hydroxyl, phospho, phosphonate, sulfo, sulfonate, carboxy, or carboxylate groups, and particularly chemically reacted or chemically non-reacted carboxy or carboxylate groups. For example, the water-dispersible acrylic polymer can be crosslinked (generally after the image receiving layer formulation has been applied to the support) through hydroxyl or carboxy groups to provide aminoester, urethane, amide, or urea groups. Mixtures of these water-dispersible acrylic polymers can be used if desired, having the same or different reactive groups.

Such water-dispersible acrylic polymers can be designed from one or more ethylenically unsaturated polymerizable monomers that will provide the desired properties of the resulting dry image receiving layer ($T_g$, crosslinkability, resistance to transferred dye fade, and thermal transferability). Generally, the useful water-dispersible acrylic polymers comprise recurring units are derived predominantly (greater than 50 mol %) from one or more ethylenically unsaturated polymerizable monomers that provide the desired properties. The remainder of the recurring units can be derived from different ethylenically unsaturated polymerizable monomers.

For example, the water-dispersible acrylic polymer comprises recurring units derived from: (a) one or more ethylenically unsaturated polymerizable acrylates or methacrylates comprising acyclic alkyl ester, cycloalkyl ester, or aryl ester groups, (b) one or more carboxy-containing or sulfo-containing ethylenically unsaturated polymerizable acrylate or methacrylate, and (c) optionally styrene or a styrene derivative.

The acyclic alkyl ester, cycloalkyl ester, or aryl ester groups can be substituted or unsubstituted, and they have up to and including 14 carbon atoms. The acyclic alkyl ester groups comprise linear and branched, substituted or unsubstituted alkyl groups including aryl-substituted alkyl groups, and aryloxy-substituted alkyl groups and can have at least 1 carbon atom and up to and including 22 carbon atoms. The cycloalkyl ester groups generally have at least 5 carbon atoms and up to and including 10 carbon atoms in the ring, and can be substituted or substituted cyclic ester groups including alkyl-substituted cyclic ester rings. Useful aryl ester groups include phenyl ester and naphthyl ester groups, which can be substituted or unsubstituted with one or more groups on the aromatic rings.

Representative examples of (a) ethylenically unsaturated polymerizable acrylates or methacrylates include but are not limited to, n-butyl acrylate, n-butyl methacrylate, t-butyl acrylate, t-butyl methacrylate, benzyl acrylate, benzyl methacrylate, 2-phenoxyethyl acrylate, stearyl methacrylate, cyclohexyl acrylate, cyclohexyl methacrylate, isobornyl methacrylate, 2-chloroethyl acrylate, benzyl 2-propyl acrylate, n-butyl 2-bromoacrylate, phenoxyacrylate, and phenoxymethacrylate. Particularly useful (a) ethylenically unsaturated polymerizable acrylates and methacrylates include benzyl acrylate, benzyl methacrylate, t-butyl acrylate, and 2-phenoxyethyl acrylate.

Representative (b) hydroxy-, phospho-, carboxy- or sulfo-containing ethylenically unsaturated polymerizable acrylates and methacrylates include but are not limited to, acrylic acid, sodium salt, methacrylic acid, potassium salt, 2-acrylamido-2-methylpropane sulfonic acid, 2-acrylamido-2-methylpropane sulfonic acid, sodium salt, 2-sulfoethyl methacrylate, sodium salt, 3-sulfopropyl methacrylate, sodium salt, and similar compounds. Acrylic acid and methacrylic acid, or salts thereof, are particularly useful so that the water-dispersible acrylic polymers comprise chemically reacted or chemically non-reacted carboxy or carboxylate groups.

The (c) ethylenically unsaturated polymerizable monomers include but are not limited to styrene, α-methyl styrene, 4-methyl styrene, 4-acetoxystyrene, 2-bromostyrene, α-bromostyrene, 2,4-dimethylstyrene, 4-ethoxystyrene, 3-trifluoromethylstyrene, 4-vinylbenzoic acid, vinyl benzyl chloride, vinyl benzyl acetate, and vinyl toluene. Styrene is particularly useful.

In these water-dispersible acrylic polymers, the (a) recurring units generally represent at least 20 mol % and up to and including 99 mol % of the total recurring units, or more typically at least 30 mol % and up to and including 98 mol % of the total recurring units in the polymer.

The (b) recurring units generally represent at least 1 mol % and up to and including 10 mol %, and typically at least 2 mol % and up to and including 4 mol %, of the total recurring units in the polymer.

In some embodiments, it is desirable to have low amounts of pendant acid groups in the water-dispersible acrylic polymers, for example such that the recurring units derived from the (a) recurring units comprise at least 1 mol % and up to and including 3 mol %, based on the total recurring units in the polymer.

When the (c) ethylenically polymerizable monomers are used to prepare the water-dispersible acrylic polymers, the recurring units derived from those monomers are generally present in an amount of at least 30 mol % and up to and including 80 mol %, or typically at least 50 mol % and up to and including 70 mol %, of the total recurring units in the polymer.

The water-dispersible acrylic polymers used in the practice of this invention can be prepared using readily available reactants and known addition polymerization conditions and free radical initiators. The preparation of some representative copolymers used in the present invention is provided below before the Examples. For example, some useful water-dispersible acrylic polymers can be obtained from Fujikura (Japan), DSM, and Eastman Kodak Company, and representative acrylic copolymers useful in this invention are described below in the Examples. Generally, the water-dispersible acrylic polymers are provided as aqueous dispersions.

Useful water-dispersible acrylic polymers also generally have a number average molecular weight ($M_n$) of at least 5,000 and up to and including 1,000,000, as measured using size exclusion chromatography.

(2) Each of the one or more water-dispersible polyesters that are present in the polymer binder matrix has a $T_g$ of 30° C. or less, or typically a $T_g$ of at least −10° C. and up to and including 30° C., or even at least 0° C. and up to and including 20° C. In general, the water-dispersible polyester is a film-forming polymer that provides a generally homogeneous film when coated as dried. Such polyesters can comprise some water-dispersible groups such as sulfo, sulfonate, carboxyl, or carboxylate groups in order to enhance the water-dispersibility. Mixtures of these water-dispersible polyesters can be used together. Useful water-dispersible polyesters can be prepared using known diacids by reaction with suitable diols. In many embodiments, the diols are aliphatic glycols and the diacids are aromatic diacids such as phthalate, isophthalate, and terephthalate, in a suitable molar ratio. Mixtures of diacids can be reacted with mixtures of glycols. Either or both of the diacid or diol can comprise suitable sulfo or carboxy groups to improve water-dispersibility. A commercial source of a useful water-dispersibility polyester is described in the Examples below. Two useful water-dispersible polyesters are copolyesters of isophthalate and diethylene glycol, and a copolymer formed from a mixture of isophthalate and terephthalate with ethylene glycol and neopentyl glycol.

The useful water-dispersible polyesters useful in the present invention can be obtained from some commercial sources such as Toyobo (Japan) and Eastman Chemical Company, and can also be readily prepared using known starting materials and condensation polymerization conditions.

Thus, in some embodiments, the thermal image receiver elements include the water-dispersible acrylic polymer that comprises recurring units derived from: (a) one or more ethylenically unsaturated polymerizable acrylates or methacrylates comprising acyclic alkyl, cycloalkyl, or aryl ester groups having at least 4 carbon atoms, (b) one or more carboxy-containing or sulfo-containing ethylenically unsaturated polymerizable acrylate or methacrylate, and (c) optionally styrene or a styrene derivative, and wherein the (a) recurring units represent at least 10 mol % and up to and including 99 mol % of the total recurring units, and the (b) recurring units represent at least 1 mol % and up to and including 10 mol %.

For example, the water-dispersible acrylic polymer in the dry image receiving layer can be crosslinked through hydroxyl or carboxy groups using a suitable crosslinking agent (described below) to provide aminoester, urethane, amide, or urea groups.

The one or more water-dispersible acrylic polymers are present in an amount of at least 55 weight %, and typically at least 60 weight % and up to and including 80 weight %, based on the total dry image receiving layer weight.

In addition, the one or more water-dispersible acrylic polymers are present in the polymer binder matrix at a dry ratio to the water-dispersible polyester of at least 1:1, or typically at least 1:1 to and including 6:1, or more likely at least 1.5:1 to and including 4:1. The polymer binder matrix forms the predominant structure of the dry image receiving layer and it contains essentially no other polymers but the (1) and (2) polymers described above. However, minor amounts (less than 10 weight % of the total dry layer weight) of other polymers can be in the dry image receiving layer for other purposes.

The dry image receiving layer (and the formulation used to make it, describe below) can include various optional components designed to provide various properties or to enhance certain conditions. The dry image receiving layer can comprise one or more surfactants that are included with the acrylic polymers during their manufacture or suspension in aqueous formulations for commercial use.

In some embodiments, the dry image receiving layer comprises one or more water-dispersible release agents that can reduce the sticking between a thermal donor element and the thermal image receiver element of this invention during thermal imaging. These compounds are generally not water-soluble, but are water-dispersible so that they are dispersed uniformly within the image receiving layer formulation (described above). These compounds can also help provide a uniform film in the dry image receiving layer during formulation and drying. These compounds can be polymeric or non-polymeric but are generally polymeric. Such compounds are not generally re-dispersible once they are coated and dried in the dry image receiving layer.

Useful water-dispersible release agents include but are not limited to, water-dispersible fluorine-based surfactants, silicone-based surfactants, modified silicone oil (such as epoxy-modified, carboxy-modified, amino-modified, alcohol-modified, fluorine-modified, alkylarylalkyl-modified, and others known in the art), and polysiloxanes. Useful modified polysiloxanes include but are not limited to, water-dispersible polyoxyalkylene-modified dimethylsiloxane graft copolymers having at least one alkylene oxide pendant chain having more than 45 alkoxide units, as described in U.S. Pat. No. 5,356,859 (Lum et al.) that is incorporated herein by reference. Other useful release agents include crosslinked amino modified polydimethylsiloxanes that can be supplied as emulsions under the tradename Siltech® from Siltech Corporation. Some useful commercial products of this type are described below in the Examples.

The useful amounts of one or more water-dispersible release agents in the dry image receiving layer are generally at least 0.5 weight % and up to and including 10 weight %, or typically at least 1 weight % and up to and including 5 weight %, based on the total weight of the dry image receiving layer. The amount of water-dispersible release agent refers to the amount of the compound, not the amount of a formulation or emulsion in which the compound may be supplied.

The dry image receiving layer can also include residual crosslinking agents. Most of the crosslinking agents used in the image receiving layer formulation are reacted during the preparation of the thermal image receiver element, but some may be residual in the dry image receiving layer. Useful crosslinking agents are described below.

The dry image receiving layer can also include one or more plasticizers, defoamers, coating aids, charge control agents, thickeners or viscosity modifiers, antiblocking agents, UV absorbers, coalescing aids, matte beads (such as organic matte particles), antioxidants, stabilizers, and fillers as is known in the art for aqueous-coated formulations These optional addenda can be provided in known amounts, but usually none individually is present in an amount greater than weight % based on the total dry image receiving layer weight.

Intermediate Layer(s):

While the dry image receiving layer is the outermost layer in the thermal image receiver element, the receiver element can have one or more intermediate layers arranged between the dry image receiving layer and the support (described below). Such intermediate layers can serve various purposes including but not limited to, antistatic properties, thermal insulation properties, adhesion properties, improve image durability, or any combination of these properties. The one or more intermediate layers are generally coated out of aqueous formulations but they could alternatively be coated out of organic solvents or extruded onto the support.

For example, it is possible to include a "thermal insulation layer" as described for example in Cols. 8-9 of U.S. Pat. No. 7,695,762 (Sekiya et al.) that is incorporated herein by reference, to provide high heat insulation properties as well as cushioning properties. Such thermal insulation layers can include microparticles dispersed within one or more binders such as hydrophilic binders (for example, as described in Cols. 11-12 of U.S. Pat. No. 7,695,762). Such microparticles can be porous or hollow polymeric particles and other such particulate materials as described for example, in U.S. Pat. No. 7,906,267 (Shinohara et al.) and U.S. Pat. No. 7,968,496 (Irita et al.) and EP 2,042,334A2 (Koide et al.), all incorporated herein by reference.

Another useful intermediate layer can be used in place of the thermal insulation layer or in addition to the thermal insulation layer. Such an intermediate layer can provide resistivity against solvents, act as a barrier to dye diffusion, provide adhesion between layers or anti-glare properties, or reduce unevenness. It can also comprise a fluorescing whitening agent dispersed within a suitable binder such as hydrophilic binder, as described in Col. 10 of U.S. Pat. No. 7,954,762 (noted above).

It is also possible to provide an intermediate layer as a cushioning layer to provide better reproducible thermal dye image transfer during printing, as described for example in U.S. Patent Application Publication 2001/0034303 (Ueno et al.) that is incorporated herein by reference.

Other intermediate layers, their composition, and purposes are described for example in U.S. Pat. No. 7,820,359 (Yoshitani et al., particularly in [0111]) that is incorporated herein by reference.

Support:

The thermal image receiver elements comprise one or more layers as described above, disposed over a suitable support. As noted above, these layers can be disposed on one or both sides of the support. From the outermost surface to the support, the thermal image receiver elements comprise a dry image receiving layer and optionally one or more intermediate layers. However, in many embodiments, the dry image receiving layer is disposed directly on one or both sides of the support. A particularly useful support comprises a polymeric film or a raw paper base comprising cellulose fibers, or a synthetic paper base comprising synthetic polymer fibers, or a resin coated cellulosic paper base. But other base supports such as fabrics and polymeric films can be used. The support can be composed of any material that is typically used in thermal imaging applications as long as the layer formulations described herein can be suitably applied thereof.

The resins used on either or both sides of a paper base are thermoplastics like polyolefins such as polyethylene, polypropylene, copolymers of these resins, or blends of these resins, in a suitable dry thickness that can be adjusted to provide desired curl characteristics. The surface roughness of this resin layer can be adjusted to provide desired conveyance properties in thermal imaging printers.

The support can be transparent or opaque, reflective or non-reflective. Opaque supports include plain paper, coated paper, resin-coated paper such as polyolefin-coated paper, synthetic paper, low density foam core based support, and low density foam core based paper, photographic paper support, melt-extrusion-coated paper, and polyolefin-laminated paper.

The papers include a broad range of papers, from high end papers, such as photographic paper to low end papers, such as newsprint. In one embodiment, Ektacolor® paper (Eastman Kodak Co.) as described in U.S. Pat. No. 5,288,690 (Warner et al.) and U.S. Pat. No. 5,250,496 (Warner et al.), both incorporated herein by reference, can be used. The paper can be made on a standard continuous fourdrinier wire machine or on other modern paper formers. Any pulp known in the art to provide paper can be used. Bleached hardwood chemical kraft pulp is useful as it provides brightness, a smooth starting surface, and good formation while maintaining strength. Papers useful in this invention are generally of caliper of at least 50 μm and up to and including 230 μm and typically at least 100 μm and up to and including 190 μm, because then the overall imaged element thickness is in the range desired by customers and for processing in existing equipment. They can be "smooth" so as to not interfere with the viewing of images. Chemical additives to impart hydrophobicity (sizing), wet strength, and dry strength can be used as needed. Inorganic filler materials such as $TiO_2$, talc, mica, $BaSO_4$ and $CaCO_3$ clays can be used to enhance optical properties and reduce cost as needed. Dyes, biocides, and processing chemicals can also be used as needed. The paper can also be subject to smoothing operations such as dry or wet calendering, as well as to coating through an in-line or an off-line paper coater.

A particularly useful support is a paper base that is coated with a resin on either side. Biaxially oriented base supports include a paper base and a biaxially oriented polyolefin sheet, typically polypropylene, laminated to one or both sides of the paper base. Commercially available oriented and non-oriented polymer films, such as opaque biaxially oriented polypropylene or polyester, can also be used. Such supports can contain pigments, air voids or foam voids to enhance their opacity. The support can also comprise microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861 that is incorporated herein by reference. Useful composite sheets are disclosed in, for example, U.S. Pat. No. 4,377,616 (Ashcraft et al.), U.S. Pat. No. 4,758,462 (Park et al.), and U.S. Pat. No. 4,632,869 (Park et al.), the disclosures of which are incorporated by reference.

The support can be voided, which means voids formed from added solid and liquid matter, or "voids" containing gas. The void-initiating particles, which remain in the finished packaging sheet core, should be from at least 0.1 and up to and including 10 μm in diameter and typically round in shape to produce voids of the desired shape and size. Microvoided polymeric films are particularly useful in some embodiments. For example, some commercial products having these characteristics that can be used as support are commercially available as 350K18 from ExxonMobil and KTS-107 (from HSI, South Korea).

Biaxially oriented sheets, while described as having at least one layer, can also be provided with additional layers that can serve to change the properties of the biaxially oriented sheet. Such layers might contain tints, antistatic or conductive materials, or slip agents to produce sheets of unique properties. Biaxially oriented sheets can be formed with surface layers, referred to herein as skin layers, which would provide an improved adhesion, or look to the support and photographic element. The biaxially oriented extrusion can be carried out with as many as 10 layers if desired to achieve some particular desired property. The biaxially oriented sheet can be made with layers of the same polymeric material, or it can be made with layers of different polymeric composition.

Useful transparent supports can be composed of glass, cellulose derivatives, such as a cellulose ester, cellulose triacetate, cellulose diacetate, cellulose acetate propionate, cellulose acetate butyrate, polyesters, such as poly(ethylene terephthalate), poly(ethylene naphthalate), poly-1,4-cyclohexanedimethylene terephthalate, poly(butylene terephthalate), and copolymers thereof, polyimides, polyamides, polycarbonates, polystyrene, polyolefins, such as polyethylene or polypropylene, polysulfones, polyacrylates, polyether imides, and mixtures thereof. The term as used herein, "transparent" means the ability to pass visible radiation without significant deviation or absorption.

The support used in the thermal image receiver elements can have a thickness of at least 50 μm and up to and including 500 μm or typically at least 75 μm and up to and including 350 μm. Antioxidants, brightening agents, antistatic or conductive agents, plasticizers and other known additives can be incorporated into the support, if desired.

Useful antistatic agents in the substrate (such as a raw paper stock) include but are not limited to, metal particles, metal oxides, inorganic oxides, metal antimonates, inorganic non-oxides, and electronically conductive polymers, examples of which are described in U.S. Patent Application 2011/0091667 (noted above) that is incorporated herein by reference. Particularly useful antistatic agents are inorganic or organic electrolytes. Alkali metal and alkaline earth salts (or electrolytes) such as sodium chloride, potassium chloride, and calcium chloride, and electrolytes comprising polyacids are useful. For example, alkali metal salts include lithium, sodium, or potassium polyacids such as salts of polyacrylic acid, poly(methacrylic acid), maleic acid, itaconic acid, crotonic acid, poly(sulfonic acid), or mixed polymers of these compounds. Alternatively, the raw base support can contain various clays such as smectite clays that include exchangeable ions that impart conductivity to the raw base support. Polymerized alkylene oxides, such as combinations of polymerized alkylene oxide and alkali metal salts as described in U.S. Pat. No. 4,542,095 (Steklenski et al.) and U.S. Pat. No. 5,683,862 (Majumdar et al.) are useful as electrolytes.

The antistatic agents can be present in the support (such as a cellulose raw base support) in an amount of up to 0.5 weight % or typically at least 0.01 weight % and up to and including 0.4 weight % based on the total support dry weight.

In another embodiment, the base support comprises a synthetic paper that is typically cellulose-free, having a polymer core that has adhered thereto at least one flange layer. The polymer core comprises a homopolymer such as a polyolefin, polystyrene, polyester, polyvinylchloride, or other typical thermoplastic polymers; their copolymers or their blends thereof; or other polymeric systems like polyurethanes and polyisocyanurates. These materials can have been expanded either through stretching resulting in voids or through the use of a blowing agent to consist of two phases, a solid polymer matrix, and a gaseous phase. Other solid materials can be present in the form of fillers that are of organic (polymeric, fibrous) or inorganic (glass, ceramic, metal) origin.

In still another embodiment, the support comprises a synthetic paper that can be cellulose-free, having a foamed polymer core or a foamed polymer core that has adhered thereto at least one flange layer. The polymers described for use in a polymer core can also be employed in manufacture of the foamed polymer core layer, carried out through several mechanical, chemical, or physical means as are known in the art.

In a many embodiments, polyolefins such as polyethylene and polypropylene, their blends and their copolymers are used as the matrix polymer in the foamed polymer core along with a chemical blowing agent such as sodium bicarbonate and its mixture with citric acid, organic acid salts, azodicarbonamide, azobisformamide, azobisisobutyroInitrile, diazoaminobenzene, 4,4'-oxybis(benzene sulfonyl hydrazide) (OBSH), N,N'-dinitrosopentamethyl-tetramine (DNPA), sodium borohydride, and other blowing agent agents well known in the art. Useful chemical blowing agents would be sodium bicarbonate/citric acid mixtures, azodicarbonamide; though others can also be used. These foaming agents can be used together with an auxiliary foaming agent, nucleating agent, and a cross-linking agent.

Where the thermal image receiver element comprises an dry image receiving layer on only one side of the support, it can be useful to apply a slip layer or anti-curl layer on the "backside" (non-imaging) of the support using suitable polymers such as acrylate or methacrylate polymers, vinyl resins such as copolymers derived from vinyl chloride and vinyl acetate, poly(vinyl alcohol-co-vinyl butyral), polyvinyl acetate, cellulose acetate, or ethyl cellulose. The backside slip layer can also comprise one or more suitable antistatic agents or anti-conductive agents that are known in the art. This slip layer can also include lubricants such as oils or semicrystalline organic solids such as beeswax. poly(vinyl stearyl), perfluorinated alkyl ester polyethers, polycaprolactone, silicone oils, or any combination thereof, as described for example in U.S. Pat. No. 5,866,506 (Tutt et al.) that is incorporated herein by reference. Useful anti-curl layers can comprise one or more polyolefins such mixtures of polyethylene and polypropylene.

Method of Making Image Receiver Elements

The thermal image receiver elements of this invention can be prepared by applying an aqueous image receiving layer formulation to at least one side of a support, and in some embodiments, the same or different aqueous receiving layer formulations can be applied to opposing sides of a support to provide a duplex thermal image receiving element.

The applied aqueous image receiving layer formulation comprises a polymer binder composition that consists essentially of the (1) and (2) polymer components described above and any optional addenda such as a surfactant (described above) for the water-dispersible acrylic polymer (described above), one or more release agents, one or more crosslinking agents (described below), and any other addenda described above. The weight ratio of the water-dispersible acrylic polymer to the water-dispersible polyester in such formulations is at least 1:1 to and including 6:1, or typically at least 1.5:1 to and including 5:1. These formulations can be applied to the support using any useful technique including coating with appropriate equipment and conditions, including but not limited to hopper coating, curtain coating, rod coating, gravure coating, roller coating, dip coating, and spray coating. The support materials are described above, but before applying the image receiving layer formulation, the support can be treated to improve adhesion using any suitable technique such as acid etching, flame treatment, corona discharge treatment, or glow discharge treatment, or it can be treated with a suitable primer layer.

After the formulation is applied, it is dried under suitable conditions of at least 20° C. to and including 100° C., and typically at a temperature of at least 60° C. Drying can be carried out in an oven or drying chamber if desired, especially in a manufacturing apparatus or production line. Drying facilitates in the crosslinking of the aqueous image receiving layer formulation and especially through the reactive groups in the water-dispersible acrylic polymer using the appropriate crosslinking agent. Crosslinking can improve the adhesion of the dry image receiving layer to the support or any immediate layer that is disposed below the dry image receiving layer.

If desired, after the image receiving layer formulation is dried, it can be treated to additional heating to enhance the crosslinking of at least some of the water-dispersible acrylic polymer, and this heat treatment can be carried out in any suitable manner with suitable equipment such as an oven, at a temperature of at least 70° C. for as long as necessary to remove at least 95% of the water in the image receiving layer formulation.

Useful crosslinking agents that can be included in the aqueous image receiving layer formulation are chosen to be reactive with the particular reactive groups on the water-dispersible acrylic polymers incorporated into the polymer binder matrix. For example, for the reactive carboxyl and carboxylate groups, the useful crosslinking agents are carbodiimides and aziridines.

One or more crosslinking agents can be present in the aqueous image receiving layer formulation in an amount that is essentially a 1:1 molar ratio or less with the reactive groups in the water-dispersible acrylic polymer in the formulation. Generally, little or no excess crosslinking agents are used in the formulation. In general, useful crosslinking agents include but are not limited to, organic compounds such as melamine formaldehyde resins, glycoluril formaldehyde resins, polycarboxylic acids and anhydrides, polyamines, epihalohydrins, diepoxides, dialdehydes, diols, carboxylic acid halides, ketenes, aziridines, carbodiimides, isocyanates, and mixtures thereof.

While the aqueous image receiving layer formulation is generally applied to the support in a uniform manner to cover most or the entire support surface, sometimes it is applied to the support and dried in a manner to form a predetermined pattern of the dry image receiving layer.

While the aqueous image receiving layer formulation can be applied directly to either or both sides of the support, in some embodiments, one or more intermediate layers formulation can be applied directly to one or both sides of the support to provide one or more intermediate layers as described above. Once the one or more intermediate layer formulations are applied and dried to form one or more intermediate layers, the aqueous image receiving layer formulation is then applied to the one or more intermediate layers on one or both sides of the support. For example, an intermediate layer can be coated out of a suitable formulation to provide cushioning, thermal insulation, antistatic properties, or other desirable properties to enhance manufacturability, element stability, thermal image transfer, and image stability.

The intermediate layer formulations are also generally applied as aqueous compositions in which the various polymeric components and any fillers, surfactants, antistatic agents, and other desirable components are dispersed or dissolved in water or a water/alcohol solvent. As noted above, the intermediate layer formulations can be applied using any suitable technique.

Thermal Donor Elements

Thermal donor elements can be used with the thermal image receiver element of this invention to provide the thermal transfer of dye, clear polymeric films, or metallic effects. Such thermal donor elements generally comprise a support having thereon an ink or dye containing layer (sometimes known as a thermal dye donor layer), a thermally transferable polymeric film, or a layer of metal particles or flakes.

Any ink or dye can be used in thermal donor elements provided that it is transferable to the dry image receiving layer of the thermal image receiver element by the action of heat. Thermal donor elements are described, for example, in U.S. Pat. No. 4,916,112 (Henzel et al.), U.S. Pat. No. 4,927,803 (Bailey et al.), and U.S. Pat. No. 5,023,228 (Henzel) that are all incorporated herein by reference. In a thermal dye transfer method of printing, a thermal donor element can be used that comprises a poly(ethylene terephthalate) support coated with sequential repeating areas (for example, patches) of cyan, magenta, or yellow ink or dye, and the ink or dye transfer steps can be sequentially performed for each color to obtain a multi-color ink or dye transfer image on either or both sides the thermal image receiver element. The support can include a black ink for labeling, identification, or text.

A thermal donor element can also include a clear protective layer ("laminate") that can be thermally transferred onto the thermal image receiver elements, either over the transferred dye images or in non-dyed portions of the thermal image receiver element. When the process is performed using only a single color, then a monochrome ink or dye transfer image can be obtained.

Thermal donor elements conventionally comprise a support having thereon a dye containing layer. Any dye can be used in the dye containing layer provided that it is transferable to the dry image receiving layer by the action of heat. Especially good results have been obtained with diffusible dyes, such as the magenta dyes described in U.S. Pat. No. 7,160,664 (Goswami et al.) that is incorporated herein by reference.

Thermal donor element can include a single color area (patch) or multiple colored areas (patches) containing dyes suitable for thermal printing. As used herein, a "dye" can be one or more dye, pigment, colorant, or a combination thereof, and can optionally be in a binder or carrier as known to practitioners in the art. For example, the dye layer can include a magenta dye combination and further comprise a yellow dye-donor patch comprising at least one bis-pyrazolone-methine dye and at least one other pyrazolone-methine dye, and a cyan dye-donor patch comprising at least one indoaniline cyan dye. A dye can be selected by taking into consideration hue, lightfastness, and solubility of the dye in the dye-containing layer binder and the dry image receiving layer binder.

Further examples of useful dyes can be found in U.S. Pat. No. 4,541,830 (Hotta et al.); U.S. Pat. No. 4,698,651 (Moore et al.); U.S. Pat. No. 4,695,287 (Evans et al.); U.S. Pat. No. 4,701,439 (Evans et al.); U.S. Pat. No. 4,757,046 (Byers et al.); U.S. Pat. No. 4,743,582 (Evans et al.); U.S. Pat. No. 4,769,360 (Evans et al.); U.S. Pat. No. 4,753,922 (Byers et al.); U.S. Pat. No. 4,910,187 (Sato et al.); U.S. Pat. No. 5,026,677 (Vanmaele); U.S. Pat. No. 5,101,035 (Bach et al.); U.S. Pat. No. 5,142,089 (Vanmaele); U.S. Pat. No. 5,374,601 (Takiguchi et al.); U.S. Pat. No. 5,476,943 (Komamura et al.); U.S. Pat. No. 5,532,202 (Yoshida); U.S. Pat. No. 5,635,440 (Eguchi et al.); U.S. Pat. No. 5,804,531 (Evans et al.); U.S. Pat. No. 6,265,345 (Yoshida et al.); and U.S. Pat. No. 7,501,382 (Foster et al.), and U.S. Patent Application Publications 2003/0181331 (Foster et al.) and 2008/0254383 (Soejima et al.), the disclosures of which are hereby incorporated by reference.

The dyes can be employed singly or in combination to obtain a monochrome dye-donor layer or a black dye-donor layer. The dyes can be used in the donor transfer element in an amount to provide, upon transfer, from 0.05 $g/m^2$ to and including 1 $g/m^2$ in the eventual dye image.

The dyes and optional addenda are generally incorporated into suitable binders in the dye-containing layers. Such binders are well known in the art and can include cellulose polymers, polyvinyl acetates of various types, polyvinyl butyral, styrene-containing polyol resins, and combinations thereof, and others that are described for example in U.S. Pat. No. 6,692,879 (Suzuki et al.), U.S. Pat. No. 8,105,978 (Yoshizawa et al.) and U.S. Pat. No. 8,114,813 (Yoshizawa et al.), U.S. Pat. No. 8,129,309 (Yokozawa et al.), and U.S. Patent Application Publications 2005/0227023 (Araki et al.) and 2009/0252903 (Teramae et al.), all of which are incorporated herein by reference.

The dye-containing layers can also include various addenda such as surfactants, antioxidants, UV absorbers, or non-transferable colorants in amounts that are known in the art. For example, useful antioxidants or light stabilizers are described for example in U.S. Pat. No. 4,855,281 (Byers) and U.S. Patent Application Publications 2010/0218887 and 2011/0067804 (both of Vreeland) that are incorporated herein by reference. The N-oxyl radicals derived from hindered amines described in the Vreeland publications are particularly useful as light stabilizers for thermal transferred dye images, both in the transferred dye layers and in protective overcoats applied to the transferred dye images.

Polymeric films ("laminates") can be thermally transferred from the donor transfer element to the thermal image receiver element. The compositions of such polymeric films are known in the art as described for example U.S. Pat. No. 6,031,556 (Tutt et al.) and U.S. Pat. No. 6,369,844 (Neumann et al.) that are incorporated herein by reference. The two Vreeland publications described above provide descriptions of protective polymeric films, their compositions, and uses.

In some embodiments, the thermal donor elements comprise a layer of metal or metal salt that can be thermally transferred to the thermal image receiver elements. Such metals can provide metallic effects, highlights, or undercoats for later transferred dye images. Useful metals that can be transferred include but are not limited to, gold, copper, silver, aluminum, and other as described below. Such thermal donor elements are described for example, in U.S. Pat. No. 5,312,683 (Chou et al.) and U.S. Pat. No. 6,703,088 (Hayashi et al.) both of which are incorporated herein by reference.

The backside of thermal donor elements can comprise a "slip" or "slipping" layer as described for example, in the Vreeland publications noted above.

Imaging Assemblies and Thermal Imaging

The thermal image receiver element can be used in an assembly of this invention in combination or "thermal association" with one or more thermal donor elements to provide a thermal transfer or image (for example dye, metal, or clear film) on one or more sides using thermal transfer means. Multiple thermal transfers to the same side, opposing side, or both sides of a thermal image receiver element can provide a multi-color image, polymeric film, or metal image on one or both sides of the substrate of the thermal image receiver element. As noted above, a metal layer or pattern can be formed on one or both sides of the substrate. In addition, a protective polymeric film (topcoat) can also be applied to one or both sides of the substrate, for example to cover a multi-color image on one or both sides of the substrate with a protective overcoat or "laminate".

Thermal transfer generally comprises imagewise-heating a thermal donor element and the thermal image receiver element of this invention and transferring a dye, metal, or clear film image to a thermal image receiver element as described above to form the dye, metal, or polymeric film image. Thus, in some embodiments, both a dye image and polymeric film are imagewise transferred from one or more thermal donor elements to the dry image receiving layer of the thermal image receiver element.

A thermal dye donor element can be employed which comprises a poly(ethylene terephthalate) support coated with sequential repeating areas of cyan, magenta, and yellow dyes (optionally black dyes or pigments), and the dye transfer steps are sequentially performed for each color to obtain a three-color (or four-color) dye transfer image on either or both sides of the support of the thermal image receiver element. Thermal transfer of a polymeric film can also be achieved in the same or different process to provide a protective overcoat on either or both sides of the support. As noted above, the thermal donor element can also be used to transfer a metal to either or both sides of the thermal image transfer element.

Thermal printing heads that can be used to transfer ink, dye, metal, or a polymeric film from thermal donor elements to the thermal image receiver element are available commercially. There can be employed, for example, a Fujitsu Thermal Head (FTP-040 MCS001), a TDK Thermal Head F415 HH7-1089, or a Rohm Thermal Head KE 2008-F3. Alternatively, other known sources of energy for transfer can be used, such as lasers as described in, for example, GB Publication 2,083,726A that is incorporated herein by reference.

An imaging assemblage generally comprises (a) a thermal donor element, and (b) a thermal image receiver element of this invention in a superposed relationship with the thermal donor element, so that the dye-containing layer, polymeric film, or metal of the thermal donor element is in thermal association or intimate contact with the dry image receiving layer. Imaging can be carried out using this assembly using known processes.

When a three-color image is to be obtained, the imaging assembly can be formed on three different occasions during the time when heat can be applied by the thermal printing head or laser. After the first dye is transferred from a first thermal donor element, the elements can be peeled apart. A second thermal donor element (or another area of the same thermal donor element with a different dye area) can be then brought in register with the dry image receiving layer and the process is repeated. A third or more color images can be obtained in the same manner. A metal layer (or pattern) or clear laminate protective film can be obtained in the same manner.

The imaging method can be carried out using either a single-head printing apparatus or a dual-head printing apparatus in which either head can be used to image one or both sides of the support. A duplex thermal image receiver element of this invention can be transported in a printing operation using capstan rollers before, during, or after forming the image. In some instances, a duplex thermal image receiver element is disposed within a rotating carousel that is used to position either side of the duplex thermal image receiver element in relationship with the printing head for imaging. In this manner, a clear film a metal pattern or layer can be transferred to either or both sides, along with the various transferred color images.

Duplex thermal image receiver elements of this invention can also receive a uniform or pattern-wise transfer of a metal including but not limited to, aluminum, copper, silver, gold, titanium nickel, iron, chromium, or zinc onto either or both sides of the substrate. Such metalized "layers" can be located over a single- or multi-color image, or the metalized layer can be the only "image". Metal-containing particles can also be transferred. Metals or metal-containing particles can be transferred with or without a polymeric binder. For example, metal flakes in a thermally softenable binder can be transferred as described for example in U.S. Pat. No. 5,312,683 (noted above). The transfer of aluminum powder is described in U.S. Pat. No. 6,703,088 (noted above). Multiple metals can be thermally transferred if desired to achieve a unique metallic effect. For example, one metal can be transferred to form a uniform metallic layer and a second metal is transferred to provide a desired pattern on the uniform metallic layer. Metals or metal-containing particles for transfer can be provided in ribbons or strips of such materials in a thermal donor element.

The present invention provides at least the following embodiments and combinations thereof, but other combinations of features are considered to be within the present invention as a skilled artisan would appreciate from the teaching of this disclosure:

1. A thermal image receiver element comprising a support, and having on at least one side of the support:

a dry image receiving layer having a $T_g$ of at least 25° C., which dry image receiving layer is the outermost layer of the thermal image receiver element, has a dry thickness of at least 05 μm and up to and including 5 μm, and comprises a water-dispersible release agent and a polymer binder matrix that consists essentially of:

(1) a water-dispersible acrylic polymer comprising chemically reacted or chemically non-reacted hydroxyl, phospho, phosphonate, sulfo, sulfonate, carboxyl, or carboxylate groups, and (2) a water-dispersible polyester that has a $T_g$ of 30° C. or less, wherein the water-dispersible acrylic polymer is present in an amount of at least 55 weight % of the total dry image receiving layer weight.

2. The thermal image receiver element of embodiment 1, wherein the water-dispersible release agent is a polysilicone that is modified with amino side chains or terminal groups, in an amount of at least 0.5 weight % based on the total dry image receiving layer weight.

3. The thermal image receiver element of embodiment 1 or 2, wherein the water-dispersible release agent is present in an amount of at least 0.5 weight % and up to and including 10 weight %, based on the total dry image receiving layer weight.

4. The thermal image receiver element of any of embodiments 1 to 3, wherein the water-dispersible acrylic polymer comprises chemically reacted or chemically non-reacted carboxy or carboxylate groups.

5. The thermal image receiver element of any of embodiments 1 to 4, wherein the water-dispersible acrylic polymer is present at a dry ratio to the water-dispersible polyester of at least 1:1.

6. The thermal image receiver element of any of embodiments 1 to 5, wherein the dry image receiving layer has a $T_g$ of at least 35° C. and up to and including 70° C.

7. The thermal image receiver element of any of embodiments 1 to 6, wherein the water-dispersible polyester has a $T_g$ of at least −10° C. and up to and including 30° C.

8. The thermal image receiver element of any of embodiments 1 to 7, wherein the water-dispersible acrylic polymer is present in an amount of at least 60 weight % and up to and including 80 weight % of the total dry image receiving layer weight, and the weight ratio of the water-dispersible acrylic polymer to the water-dispersible polyester in the polymer binder matrix is from 1:1 to and including 6:1.

9. The thermal image receiver element of any of embodiments 1 to 8, wherein the water-dispersible acrylic polymer comprises recurring units derived from: (a) one or more ethylenically unsaturated polymerizable acrylates or methacrylates comprising acyclic alkyl ester, cycloalkyl ester, or aryl ester groups having at least 4 carbon atoms, (b) one or more carboxy-containing or sulfo-containing ethylenically unsaturated polymerizable acrylate or methacrylate, and (c) optionally styrene or a styrene derivative, and wherein the (a) recurring units represent at least 20 mol % and up to and including 99 mol % of the total recurring units, and the (b) recurring units represent at least 1 mol % and up to and including 10 mol %.

10. The thermal image receiver element of any of embodiments 1 to 9 that is a duplex thermal image receiver element comprising the same or different dry image receiving layer on both of opposing sides of the support.

11. The thermal image receiver element of any of embodiments 1 to 10, wherein the support comprises a cellulosic paper based or a synthetic paper base, and the support optionally comprises a conductive agent.

12. The thermal image receiver element of any of embodiments 1 to 11, wherein the dry image receiver layer is disposed directly on one or both of opposing sides of the support.

13. The thermal image receiver element of any of embodiments 1 to 12, further comprising an intermediate layer between the support and the dry image receiving layer on one or both of opposing sides of the support.

14. An imaging assembly comprising the thermal image receiver element of any of embodiments 1 to 13, in thermal association with a thermal donor element.

15. A method for making the thermal image receiver element of any of embodiments 1 to 13, comprising:

applying an aqueous image receiving layer formulation to one or both of the opposing sides of a support, the aqueous image receiving layer formulation comprising a water-dispersible release agent and a polymer binder composition consisting essentially of:

(1) a water-dispersible acrylic polymer comprising chemically reacted or chemically non-reacted hydroxyl, phospho, phosphonate, sulfo, sulfonate, carboxy, or carboxylate groups, and (2) a water-dispersible polyester that has a $T_g$ of 30° C. or less, wherein the water-dispersible acrylic polymer is present in an amount of at least 55 weight % of the resulting total dry image receiving layer weight, and is present in the polymeric binder matrix at a dry ratio to the water-dispersible polyester of at least 1:1 to and including 6:1, and drying the aqueous image receiving layer formulation to form a dry image receiving layer on one or both opposing sides of the support.

16. The method of embodiment 15, wherein the aqueous image receiving layer formulation further comprises a crosslinking agent for the water-dispersible acrylic polymer.

17. The method of embodiment 15 or 16, wherein the aqueous image receiving layer formulation is heat treated at a temperature of at least 70° C. to crosslink at least some of the water-dispersible acrylic polymer.

18. The method of any of embodiments 15 to 17, wherein the aqueous image receiving layer formulation is applied to the support and dried to provide the dry image receiving layer in a predetermined pattern.

19. The method of any of embodiments 15 to 18, wherein the same aqueous image receiving layer formulation is applied to opposing sides of the support.

20. A method for making a thermal image, comprising:

imagewise transferring a clear polymeric film, one or more a dye images, or both a clear polymeric film and one or more dye images, from a thermal donor element to the image receiving layer of the dry thermal image receiving element of any of embodiments 1 to 13.

The following Examples are provided to illustrate the practice of this invention and are not meant to be limiting in any manner.

Various copolymers were prepared for evaluation in the thermal image receiver elements, and these copolymers were prepared using the following procedure and components. An emulsion of ethylenically unsaturated polymerizable monomers was prepared with the following composition:

| Monomer emulsion: | |
|---|---|
| Monomers (TABLE I) | 400 g |
| Water | 395 g |
| Rhodacal ® A-246L surfactant (Solvay Rhodia) | 5 g |
| **Reactor Contents:** | |
| Water | 195 g |
| Rhodacal ® A-246L surfactant | 5 g |
| 45% KOH | 1.54 g |
| "ACVA" | 2 g |

The polymerization procedure was carried out as follows:

1) Add water and Rhodacal® A-246L surfactant to the reactor and heat the mixture to 75° C.

2) Prepare the emulsion using the ethylenically unsaturated polymerizable monomers shown below in TABLE I with starting mol % for each monomer.

3) Add the azobiscyanovaleric acid (ACVA) free radical initiator and the 45 weight % potassium hydroxide to the reactor.

4) Meter the monomer emulsion into the reactor over 6 hours.

5) Maintain the reaction mixture at 75° C. for another 3 hours, and then cool the reaction mixture to 25° C.

6) Adjust the reaction mixture to desire pH using 1N KOH.

TABLE I

Monomer ratios in mol %

| Emulsion | Benzyl Methacrylate | Styrene | Butyl Acrylate | Butyl Methacrylate | Benzyl Acrylate | Methacrylic acid | Acrylic Acid | Phenoxyethyl acrylate | Isobornyl Methacrylate | Cyclohexyl acrylate | Methyl Methacrylate |
|---|---|---|---|---|---|---|---|---|---|---|---|
| 1 | 84.4 | 0.0 | 11.7 | 0.0 | 0.0 | 3.9 | 0.0 | 0.0 | 0.0 | 0.0 | 0.0 |
| 2 | 43.7 | 0.0 | 0.0 | 50.9 | 0.0 | 5.4 | 0.0 | 0.0 | 0.0 | 0.0 | 0.0 |
| 3 | 0.0 | 63.8 | 31.1 | 0.0 | 0.0 | 5.1 | 0.0 | 0.0 | 0.0 | 0.0 | 0.0 |
| 4 | 87.5 | 0.0 | 10.6 | 0.0 | 0.0 | 2.0 | 0.0 | 0.0 | 0.0 | 0.0 | 0.0 |
| 5 | 51.3 | 0.0 | 0.0 | 46.9 | 0.0 | 1.8 | 0.0 | 0.0 | 0.0 | 0.0 | 0.0 |
| 6 | 0.0 | 70.0 | 28.0 | 0.0 | 0.0 | 1.9 | 0.0 | 0.0 | 0.0 | 0.0 | 0.0 |
| 7 | 9.8 | 68.6 | 18.9 | 0.0 | 0.0 | 2.7 | 0.0 | 0.0 | 0.0 | 0.0 | 0.0 |
| 8 | 7.9 | 62.3 | 27.1 | 0.0 | 0.0 | 2.7 | 0.0 | 0.0 | 0.0 | 0.0 | 0.0 |
| 9 | 7.8 | 62.0 | 27.0 | 0.0 | 0.0 | 0.0 | 3.2 | 0.0 | 0.0 | 0.0 | 0.0 |
| 10 | 0.0 | 65.4 | 23.0 | 0.0 | 8.4 | 0.0 | 3.1 | 0.0 | 0.0 | 0.0 | 0.0 |
| 11 | 0.0 | 70.7 | 0.0 | 0.0 | 0.0 | 2.9 | 0.0 | 26.4 | 0.0 | 0.0 | 0.0 |
| 12 | 0.0 | 71.9 | 0.0 | 0.0 | 0.0 | 0.0 | 3.5 | 24.7 | 0.0 | 0.0 | 0.0 |
| 13 | 0.0 | 61.0 | 18.4 | 0.0 | 17.4 | 0.0 | 3.3 | 0.0 | 0.0 | 0.0 | 0.0 |
| 14 | 76.6 | 0.0 | 0.0 | 0.0 | 18.7 | 0.0 | 4.7 | 0.0 | 0.0 | 0.0 | 0.0 |
| 15 | 0.0 | 66.4 | 0.0 | 0.0 | 0.0 | 3.0 | 0.0 | 30.6 | 0.0 | 0.0 | 0.0 |
| 16 | 0.0 | 67.7 | 0.0 | 0.0 | 0.0 | 0.0 | 3.6 | 28.7 | 0.0 | 0.0 | 0.0 |
| 17 | 76.1 | 0.0 | 0.0 | 0.0 | 0.0 | 0.0 | 4.8 | 19.0 | 0.0 | 0.0 | 0.0 |
| 18 | 0.0 | 0.0 | 0.0 | 0.0 | 0.0 | 0.0 | 3.6 | 33.9 | 0.0 | 0.0 | 62.5 |

TABLE I-continued

| | Monomer ratios in mol % | | | | | | | | | | |
|---|---|---|---|---|---|---|---|---|---|---|---|
| Emulsion | Benzyl Methacrylate | Sty-rene | Butyl Acrylate | Butyl Methacrylate | Benzyl Acrylate | Methacrylic acid | Acrylic Acid | Phenoxy-ethyl acrylate | Isobornyl Methacrylate | Cyclohexyl acrylate | Methyl Methacrylate |
| 19 | 0.0 | 65.2 | 0.0 | 0.0 | 31.4 | 0.0 | 3.4 | 0.0 | 0.0 | 0.0 | 0.0 |
| 20 | 49.4 | 0.0 | 0.0 | 0.0 | 0.0 | 0.0 | 4.5 | 0.0 | 0.0 | 46.1 | 0.0 |
| 21 | 47.8 | 0.0 | 0.0 | 0.0 | 0.0 | 3.8 | 0.0 | 0.0 | 0.0 | 48.4 | 0.0 |
| 22 | 0.0 | 0.0 | 0.0 | 0.0 | 0.0 | 0.0 | 5.4 | 59.2 | 35.3 | 0.0 | 0.0 |

The following TABLE II describes the chemical and properties of the copolymers (as emulsions) prepared using the ethylenically unsaturated polymerizable monomers shown in TABLE I.

TABLE II

| Emulsion Copolymer | $T_g$ | Average Latex Particle Size (nm) | Mole % Aromatic Recurring Units | pH | Emulsion % Solids |
|---|---|---|---|---|---|
| E-1 | 54.9 | 95.8 | 84.4 | 8.0 | 37.9 |
| E-2 | 51.2 | 100.3 | 43.7 | 8.0 | 38.9 |
| E-3 | 49.3 | 81.9 | 63.8 | 8.0 | 38.4 |
| E-4 | 55.4 | 98.1 | 87.5 | 8.0 | 40.4 |
| E-5 | 49.9 | 107.8 | 51.3 | 8.0 | 40.3 |
| E-6 | 50.6 | 85.4 | 70.0 | 8.0 | 39.4 |
| E-7 | 62.8 | 82.4 | 78.4 | 8.0 | 39.4 |
| E-8 | 50.3 | 81.2 | 70.2 | 8.0 | 39.0 |
| E-9 | 46.8 | 81.7 | 69.8 | 8.0 | 37.0 |
| E-10 | 50.2 | 80.6 | 73.8 | 7.4 | 36.7 |
| E-11 | 58.5 | 85.7 | 97.1 | 7.4 | 38.3 |
| E-12 | 58.5 | 87.9 | 96.5 | 7.4 | 37.9 |
| E-13 | 43.6 | 77.3 | 74.6 | 7.4 | 36.5 |
| E-14 | 53.1 | 102 | 95.3 | 7.4 | 38.6 |
| E-15 | 53.5 | 82.7 | 97.0 | 7.4 | 38.4 |
| E-16 | 56.2 | 81.4 | 96.4 | 7.4 | 37.3 |
| E-17 | 47.8 | 110.4 | 95.2 | 7.4 | 39.4 |
| E-18 | 46.2 | 83.7 | 33.9 | 7.4 | 37.0 |
| E-19 | 60.9 | 87.2 | 96.6 | 7.4 | 38.4 |
| E-20 | 50.8 | 95.8 | 49.4 | 7.4 | 38.5 |
| E-21 | 51.7 | 88.7 | 47.8 | 7.4 | 37.5 |
| E-22 | 42.2 | 89.5 | 59.2 | 7.4 | 38.1 |
| E-23 | 54.3 | 82.1 | 52.4 | 7.4 | 36.8 |
| E-24 | 56.3 | 92.3 | 49.7 | 7.4 | 37.6 |
| E-25 | 61.8 | 83.1 | 79.3 | 7.4 | 37.8 |
| E-26 | 65.7 | 91.1 | 54.9 | 7.4 | 38.2 |

Invention and Comparative Examples

Formation of Thermal Image

Receiver Elements

All of the Control Examples and Invention Examples I1 through I58 were prepared using aqueous image receiving layer formulations that were designed to provide a dye image receiving layer having a dry coverage of 2.2 g/m$^2$. For Invention Examples I59 through I73, the aqueous image receiving layer formulations were designed to provide image receiving layers having a dry coverage of 1.1 g/m$^2$. In addition, all aqueous image receiving layer formulations was designed to have about 10% solids that would include all of the solid components shown for each formulation in TABLE III below. For the Control C1 formulation, all of the solids were the water-dispersible polyester (Vylonal® MD-1480, provided as 25 weight % dispersion in water from Toyobo) that provided 100% of the solids in the resulting dye image receiving layer. The Control C1 image receiving layer formulation was prepared by dispersing only the water-dispersible polyester in water with brief stirring, and the Control C2 image receiving layer formulation was similarly prepared with 98% solids of the same water-dispersible polyester dispersion as well as 2% solids of the release agent (Siltech® E2150).

To prepare the Control formulations C3 to C31 and Invention formulations I1 to I29, the release agent (35 weight % dispersion) was diluted with about 258 g of water, and then the acrylic polymer emulsion (see TABLE II for % solids) was added to this mixture, with brief stirring. The Control formulations C3 to C31 contained no water-dispersible polyesters.

For each of the Invention formulations I1 through I29, the resulting image receiving layer comprised 30 weight % of the water-dispersible polyester (Vylonal® MD-1480, provided as 25 weight % dispersion in water from Toyobo), 67 weight % of the acrylic polymer, and 3 weight % of the release agent (Siltech® E2150, provided as 35 weight % dispersion in water from Siltech).

For each of the Invention formulations 130 through 158, the resulting image receiving layer comprised 30 weight % of the water-dispersible polyester (Vylonal® MD-1480, provided as 25 weight % dispersion in water from Toyobo), 64 weight % of the acrylic polymer, 4 weight % of the crosslinking agent (carbodiimide XL-1, provided as 40 weight % dispersion in water from DSM), and 2 weight % of the release agent (Siltech® E2150). To prepare the Invention formulations 130 to 158, the release agent (35 weight % dispersion) was diluted with about 243 g of water, and then about 42 g the polyester dispersion (25 weight % dispersion) was added to this mixture, followed by addition of the acrylic polymer (see TABLE II for % solids) and carbodiimide crosslinking agent XL-1 (40 weight % dispersion), with brief stirring.

For each of Invention Formulations 159 through 173, the resulting image receiving layer comprised 15 weight % of the water-dispersible polyester (Vylonal® MD-1480, provided as 25 weight % dispersion in water from Toyobo), 32 weight % of the acrylic polymer, 1 weight % of the crosslinking agent (carbodiimide XL-1, provided as 40 weight % dispersion in water from DSM), and 1 weight % of the release agent (Siltech® E2150).

Each dye image receiving layer formulation was hand coated onto a sample of substrate comprising microvoided layers on opposing sides of a paper stock base (such as KTS-107 laminate that is available from HSI, South Korea) and dried to provide the 2.2 (or 1.1) g/m$^2$ dry coverage for the resulting dry image receiving layer. There was no intermediate layer between the support and the dry image receiving layer for any of the thermal image receiving elements.

Each of the Control and Invention dye image receiving layer formulations and resulting thermal image receiver element were evaluated for various properties in the following manner.

Coating Quality:

Coating quality was visually evaluated (without magnification) and given one of three ratings. A visual rating of "poor" means that the coated and dried image receiving layer was not uniform as coating lines were visible and reticulation (mottle) was very prominent. A visual rating of "OK" means some coating lines and reticulation were evident but the dry image receiving layer quality was acceptable. A visual evaluation of "Good" means that the dry image receiving layer was very uniformly glossy and smooth with no visibly noticeable coating lines or reticulation.

Donor-Receiver Sticking:

The donor-receiver sticking quality was visually evaluated (without magnification) after "printing" or forming the thermal assembly of donor element and thermal image receiver element. An evaluation of "poor" means that the dye donor layer in the donor element generally delaminated from the donor element support during thermal dye transfer (printing). An evaluation of "OK" means that dye donor layer did not delaminate from the donor element support, but there was chattering noise in the printer and some chatter lines in some of the resulting thermally transferred dye images. An evaluation of "Good" means that no sticking defects were evident in the resulting thermally transferred dye images.

Grey-Scale Transition:

A smooth gradual transition of optical density is critical for a quality highlight print. Therefore, a measure of grey-scale transition at a low optical density region, such as, in the situation of a highlight printing, was visually evaluated (without magnification) by determining the density continuity over 18 incremental optical density steps from minimum density ($D_{min}$, or energy step 18) to maximum density ($D_{max}$>1.5 or energy step 1) and at which step (step x) the particular image was lost or discontinuity in optical density was observed, which can also be illustrated effectively in a sensitometric curves, that is, optical density vs. energy steps, and the associated sensitometric data.

An evaluation of "Poor" means that a difference in optical density, that is, ΔOD<0.015 between step x and step 18 (or $D_{min}$), or a least-square slope that is <0.002 (absolute value) based on the sensitometric curve between step x and step 18 (or $D_{min}$), was obtained. An evaluation of "OK" means that an optical density difference (ΔOD) of at least 0.010 to 0.058 between step x and step 18 (or $D_{min}$), or a least-square slope at least 0.002 to 0.006 (absolute value) based on the sensitometric curve between step x and step 18 (or $D_{min}$), was obtained. An evaluation of "Good" means that a difference in optical density, i.e., ΔOD>0.042 between step x and step 18 (or $D_{min}$), or a least-square slope>0.006 (absolute value) based on the sensitometric curve between step x and step 18 (or $D_{min}$), was obtained.

$D_{max}$ of Neutral (Red, Green, or Blue of Neutral):

As used in the practice of this invention $D_{max}$ of Neutral is a measure of an aim maximum optical density of a neutral hue that can be obtained from an imaged thermal print using a given set of dye donor elements, thermal image receiver elements, and thermal printing conditions. Since the aim neutral hue, $D_{max}$ of Neutral, is composed of a composite of the thermally transferred yellow, magenta, and cyan dyes from respective color dye donor element patches, the optical density of the respective color dye, that is $D_{max}$ (Red of Neutral), $D_{max}$ (Green of Neutral), and $D_{max}$ (Blue of Neutral), can be obtained separately in the printed thermal images using a Gretag Macbeth SpectroScan machine. In the results shown below in TABLE III, the smaller absolute values are better because they show a smaller deviation of the image color from the aim optical density at $D_{max}$, and the color images are thus closer to that aim optical density.

The results of these evaluations are provided below in TABLE III. It is apparent from these results that while the Control formulations and thermal image receiver elements provided some good qualities, they did not consistently provide all of the desired properties. However, the Invention formulations and thermal image receiver elements provided desired results for most if not all of the needed properties.

In particular, it is apparent that when the film-forming polyester is not present, the coating quality (as a result of film-forming property) and overall print (image) performance such as donor-receiver sticking, print uniformity, and dye transfer efficiency (such as $D_{max}$) as listed in TABLE III below usually deteriorated and became less desirable as a high quality color image. For example, when comparisons are made among Controls C3-C5, Inventions I1-I3, and Inventions I30-32, the coating quality and donor-receiver sticking performances were poor for the Controls as compared to the Invention examples. In comparisons made among Controls C8-23 and C-28, Inventions I6-I18, and Inventions I25-I50, all of the examples demonstrated good donor-receiver sticking properties but the $D_{max}$ values of the Control examples were noticeably worse than the $D_{max}$ values of the Invention examples.

When the acrylic latex was not present (Controls C1 and C2), the donor ribbon (element) did not separate easily during the thermal printing process and it usually stuck tightly to the thermal image receiving element, causing serious printing and print quality problems. In addition, the image receiving layer of Control C1 tended to adhere to the opposite side of the thermal image receiver element, particularly when it was in roll form or in cut sheet stacked format.

A comparison of Control C1 (no release agent) and Control C2 (release agent) indicates that the presence of a water-dispersible release agent in the image receiving layer formulation reduces sticking of the donor element to the thermal image receiver element during the thermal printing process.

When a crosslinking agent was present in the dye image receiving layer formulations, the donor-receiver sticking problem (improved the donor-receiver release property) was reduced such that less release agent was required in the image receiving layer, which in turn helps promote an improved adhesion between the clear laminate protective film and the image receiving layer, which is a desirable property.

TABLE III

| Thermal Image Receiver Element | Acrylic Polymer Latex | Polyester Resin?* | Coating Quality | Donor-Receiver Sticking | Grey Scale Transition | $D_{max}$ (Red of Neutral) | $D_{max}$ (Green of Neutral) | $D_{max}$ (Blue of Neutral) |
|---|---|---|---|---|---|---|---|---|
| C1 | None | Yes | Good | Poor | NA | NA | NA | NA |
| C2 | None | Yes | Good | OK | NA | NA | NA | NA |
| C3 | DSM NeoCryl ™ A-6092 | No | Poor | Poor | NA | NA | NA | NA |

TABLE III-continued

| Thermal Image Receiver Element | Acrylic Polymer Latex | Polyester Resin?* | Coating Quality | Donor-Receiver Sticking | Grey Scale Transition | $D_{max}$ (Red of Neutral) | $D_{max}$ (Green of Neutral) | $D_{max}$ (Blue of Neutral) |
|---|---|---|---|---|---|---|---|---|
| C4 | DSM NeoCryl ™ A-6015 | No | Poor | Poor | NA | NA | NA | NA |
| C5 | DSM NeoCryl ™ XK-220 | No | Poor | Poor | NA | NA | NA | NA |
| I1 | DSM NeoCryl ™ 6092 | Yes | Good | Good | Good | −12% | −24% | −26% |
| I2 | DSM NeoCryl ™ 6015 | Yes | Good | Good | Good | −11% | −22% | −25% |
| I3 | DSM NeoCryl ™ XK-220 | Yes | Good | Good | Good | −10% | −20% | −22% |
| I30 | DSM NeoCryl ™ 6092 | Yes | Good | Good | Good | −12% | −23% | −24% |
| I31 | DSM NeoCryl ™ 6015 | Yes | Good | Good | Good | −10% | −19% | −21% |
| I32 | DSM NeoCryl ™ XK-220 | Yes | Good | Good | Good | −11% | −21% | −23% |
| C10 | E-5 | No | Poor | Good | Poor | −11% | −21% | −26% |
| C12 | E-7 | No | Poor | Good | Poor | −10% | −19% | −21% |
| I8 | E-5 | Yes | Good | Good | Poor | −10% | −17% | −22% |
| I10 | E-7 | Yes | Good | Good | Poor | −6% | −12% | −14% |
| I37 | E-5 | Yes | OK | Good | Poor | −9% | −15% | −19% |
| I39 | E-7 | Yes | OK | Good | Poor | −8% | −13% | −13% |
| C6 | E-1 | No | Poor | OK | Poor | −9% | −14% | −18% |
| C7 | E-2 | No | OK | Poor | NA | NA | NA | NA |
| C8 | E-3 | No | OK | OK | Good | −11% | −20% | −20% |
| C9 | E-4 | No | OK | Good | Good | −6% | −11% | −16% |
| C10 | E-5 | No | Poor | Good | Poor | −11% | −21% | −26% |
| C11 | E-6 | No | OK | Good | Poor | −12% | −21% | −21% |
| C12 | E-7 | No | Poor | Good | Poor | −10% | −19% | −21% |
| C13 | E-8 | No | Poor | Good | Poor | −10% | −16% | −16% |
| C14 | E-9 | No | OK | Good | OK | −10% | −16% | −15% |
| C15 | E-10 | No | OK | Good | OK | −7% | −14% | −13% |
| C16 | E-11 | No | Poor | Good | Poor | −5% | −8% | −10% |
| C17 | E-12 | No | Good | Good | OK | −3% | −7% | −10% |
| C18 | E-13 | No | Good | Good | Good | −4% | −7% | −9% |
| C19 | E-14 | No | Good | Good | OK | −2% | −6% | −13% |
| C20 | E-15 | No | OK | Good | OK | −4% | −6% | −8% |
| C21 | E-16 | No | OK | Good | OK | −4% | −6% | −8% |
| C22 | E-17 | No | Good | Good | OK | −3% | −6% | −11% |
| C23 | E-18 | No | Poor | Good | OK | −7% | −13% | −18% |
| C24 | E-19 | No | Poor | Good | OK | −5% | −11% | −12% |
| C25 | E-20 | No | Poor | Good | OK | −8% | −18% | −20% |
| C26 | E-21 | No | Poor | Good | OK | −8% | −18% | −20% |
| C27 | E-22 | No | Poor | Poor | NA | −9% | −12% | −12% |
| C28 | E-23 | No | Poor | Good | OK | −4% | −7% | −9% |
| C29 | E-24 | No | Poor | Poor | NA | −9% | −19% | −21% |
| C30 | E-25 | No | Good | Good | Good | −8% | −17% | −16% |
| C31 | E-26 | No | Good | Good | Poor | −9% | −21% | −24% |
| I4 | E-1 | Yes | Good | Good | Good | −6% | −9% | −13% |
| I5 | E-2 | Yes | Good | Good | Good | −8% | −16% | −19% |
| I6 | E-3 | Yes | Good | Good | Good | −8% | −14% | −15% |
| I7 | E-4 | Yes | Good | Good | Good | −6% | −8% | −13% |
| I9 | E-6 | Yes | Good | Good | Good | −11% | 17% | −18% |
| I11 | E-8 | Yes | Good | Good | Good | −7% | −10% | −11% |
| I12 | E-9 | Yes | Good | Good | Good | −7% | −12% | −11% |
| I13 | E-10 | Yes | Good | Good | Good | −5% | −10% | −10% |
| I14 | E-11 | Yes | Good | Good | Good | −4% | −6% | −9% |
| I15 | E-12 | Yes | Good | Good | Good | −2% | −5% | −8% |
| I16 | E-13 | Yes | Good | Good | Good | −3% | −5% | −8% |
| I17 | E-14 | Yes | Good | Good | Good | −2% | −4% | −9% |
| I18 | E-15 | Yes | Good | Good | Good | −2% | −4% | −6% |
| I19 | E-16 | Yes | Good | Good | Good | −3% | −5% | −7% |
| I20 | E-17 | Yes | Good | Good | Good | −2% | −5% | −9% |
| I21 | E-18 | Yes | Good | Good | Good | −6% | −11% | −15% |
| I28 | E-25 | Yes | Good | Good | Good | −4% | −9% | −9% |
| I29 | E-26 | Yes | Good | Good | Good | −5% | −12% | −15% |
| I33 | E-1 | Yes | OK | Good | Good | −5% | −8% | −11% |

TABLE III-continued

| Thermal Image Receiver Element | Acrylic Polymer Latex | Polyester Resin?* | Coating Quality | Donor-Receiver Sticking | Grey Scale Transition | $D_{max}$ (Red of Neutral) | $D_{max}$ (Green of Neutral) | $D_{max}$ (Blue of Neutral) |
|---|---|---|---|---|---|---|---|---|
| I34 | E-2 | Yes | Good | Good | Good | −8% | −13% | −17% |
| I35 | E-3 | Yes | Good | Good | Good | −11% | −15% | −15% |
| I36 | E-4 | Yes | OK | Good | Good | −4% | −7% | −10% |
| I38 | E-6 | Yes | OK | Good | Good | −12% | −17% | −17% |
| I40 | E-8 | Yes | OK | Good | Good | −8% | −11% | −10% |
| I41 | E-9 | Yes | Good | Good | Good | −10% | −13% | −10% |
| I42 | E-10 | Yes | Good | Good | Good | −8% | −10% | −8% |
| I43 | E-11 | Yes | OK | Good | Good | −5% | −7% | −8% |
| I44 | E-12 | Yes | Good | Good | Good | −4% | −6% | −8% |
| I45 | E-13 | Yes | Good | Good | Good | −3% | −5% | −5% |
| I46 | E-14 | Yes | Good | Good | Good | −1% | −3% | −8% |
| I47 | E-15 | Yes | OK | Good | Good | −4% | −6% | −7% |
| I48 | E-16 | Yes | Good | Good | Good | −4% | −5% | −5% |
| I49 | E-17 | Yes | Good | Good | Good | −2% | −3% | −6% |
| I50 | E-18 | Yes | Good | Good | Good | −7% | −11% | −13% |
| I51 | E-19 | Yes | Good | Good | Good | −5% | −8% | −8% |
| I52 | E-20 | Yes | Good | Good | Good | −6% | −12% | −13% |
| I53 | E-21 | Yes | Good | Good | Good | −6% | −11% | −14% |
| I54 | E-22 | Yes | Good | Good | Good | −4% | −7% | −7% |
| I55 | E-23 | Yes | Good | Good | Good | −5% | −7% | −6% |
| I56 | E-24 | Yes | Good | Good | Good | −5% | −12% | −13% |
| I57 | E-25 | Yes | Good | Good | Good | −7% | −12% | −9% |
| I58 | E-26 | Yes | Good | Good | Good | −5% | −12% | −14% |
| I59 | E-12 | Yes | Good | Good | Good | −1% | −2% | −3% |
| I60 | E-13 | Yes | Good | Good | Good | −5% | −6% | −5% |
| I61 | E-14 | Yes | Good | Good | Good | −1% | −4% | −6% |
| I62 | E-15 | Yes | Good | Good | Good | −2% | −3% | −2% |
| I63 | E-16 | Yes | Good | Good | Good | −3% | −3% | −2% |
| I64 | E-17 | Yes | Good | Good | Good | −1% | −1% | −2% |
| I65 | E-18 | Yes | Good | Good | Good | −6% | −9% | −10% |
| I66 | E-19 | Yes | Good | Good | Good | −3% | −5% | −4% |
| I67 | E-20 | Yes | Good | Good | Good | −6% | −11% | −10% |
| I68 | E-21 | Yes | Good | Good | Good | −5% | −11% | −10% |
| I69 | E-22 | Yes | Good | Good | Good | −4% | −5% | −4% |
| I70 | E-23 | Yes | Good | Good | Good | −2% | −3% | −2% |
| I71 | E-24 | Yes | Good | Good | Good | −5% | −11% | −9% |
| I72 | E-25 | Yes | Good | Good | Good | −4% | −8% | −5% |
| I73 | E-26 | Yes | Good | Good | Good | −4% | −10% | −8% |

"NA" means the datum is not available because of donor-receiver sticking.
*Toyobo's Vylonal ™ MD-1480

The invention has been described in detail with particular reference to certain preferred embodiments thereof, but it will be understood that variations and modifications can be effected within the spirit and scope of the invention.

The invention claimed is:

1. A thermal image receiver element comprising a support, and having on at least one side of the support:

a dry image receiving layer having a $T_g$ of at least 25° C., which dry image receiving layer is the outermost layer of the thermal image receiver element, has a dry thickness of at least 0.5 μm and up to and including 5 μm, and comprises a water-dispersible release agent, and a polymer binder matrix that consists essentially of:

(1) a water-dispersible acrylic polymer comprising chemically reacted or chemically non-reacted hydroxyl, phospho, phosphonate, sulfo, sulfonate, carboxyl, or carboxylate groups, and (2) a water-dispersible polyester that has a $T_g$ of 30° C. or less, wherein the water-dispersible acrylic polymer is present in an amount of at least 55 weight % of the total dry image receiving layer weight;

wherein the water dispersible release agent is selected from the group consisting of a water-dispersible fluorine-based surfactant, a silicone-based surfactant, a modified silicone oil, a polysiloxane, a modified polysiloxane and a cross-linked amino modified polydimethyl siloxane.

2. The thermal image receiver element of claim 1, wherein the water-dispersible release agent is a polysilicone that is modified with amino side chains and/or terminal groups, in an amount of at least 0.5 weight % based on the total dry image receiving layer weight.

3. The thermal image receiver element of claim 1, wherein the water-dispersible release agent is a polysilicone that is modified with amino side chains or terminal groups, and is present in an amount of at least 1 weight %, 2 weight %, or 3 weight %, based on the total dry image receiving layer weight.

4. The thermal image receiver element of claim 1, wherein the water-dispersible release agent is present in an amount of at least 1.0 weight % and up to and including 5 weight %, based on the total dry image receiving layer weight.

5. The thermal image receiver element of claim 1 wherein the image receiving layer comprises the water-dispersible acrylic polymer and the water-dispersible polyester at a ratio of 2:3 to 1 and comprises 3 weight % release agent.

6. The thermal image receiver element of claim 1 wherein the image receiving layer comprises the water-dispersible acrylic polymer and the water-dispersible polyester at a ratio of 2:1 to 1 and comprises 2 weight % release agent.

7. The thermal image receiver element of claim 1 wherein the image receiving layer comprises the water-dispersible acrylic polymer and the water-dispersible polyester at a ratio of 2:1 to 1 and comprises 1 weight % release agent.

8. The thermal image receiver element of claim 1, wherein the water-dispersible release agent is a water-dispersible polyoxyalkylene-modified dimethylsiloxane graft copolymer having at least one alkylene oxide pendant chain having more than 45 alkoxide units.

9. The thermal image receiver element of claim 1, further comprising a residual crosslinking agent.

10. The thermal image receiver element of claim 1, wherein the residual crosslinking agent is a carbodiimide or an aziridine derivative compound.

11. The thermal image receiver element of claim 1, wherein the residual crosslinking agent is an individual compound or mixture of compounds chosen from the group consisting of melamine formaldehyde resins, glycoluril formaldehyde resins, plycarboxylic acids and anhydrides, plyamines, epihalohydrins, diepoxides, dialdehydes, diols, carboxylic acid halides, ketenes, aziridines, carbodiimides, and isocyanates.

12. A thermal image receiver element comprising a support, and having one or both of opposing sides of the support:

a dry image receiving layer having a $T_g$ of at least 35° C. and up to and including 60° C., which dry image receiving layer is the outermost layer of the thermal image receiver element, has a dry thickness of at least 1 μm and up to and including 3 μm, comprising:

a water-dispersible release agent, wherein the water dispersible release agent is a crosslinked amino modified polysiloxane present in an amount of at least 1 weight % and up to and including 5 weight %, based on the total dry image receiving layer weight;

a residual crosslinking agent, wherein the residual crosslinking agent is a carbodiimide or an aziridine derivative compound; and a polymer binder matrix that consists essentially of:

(1) a water-dispersible acrylic polymer comprising chemically reacted or chemically non-reacted carboxy or carboxylate groups, wherein the water-dispersible acrylic polymer further comprises recurring ethylenically unsaturated polymerizable monomer units derived from styrene or a styrene derivative; and (2) a water-dispersible, film-forming polyester that has a $T_g$ of at least 0° C. and up to and including 20° C., which water-dispersible, film-forming polyester having water-dispersibility groups, wherein the polyester is a VYLONAL® MD-1480.

13. A method for making the thermal image receiver element of claim 1, comprising:

applying an aqueous image receiving layer formulation to one or both of the opposing sides of a support, the aqueous image receiving layer formulation comprising a water-dispersible release agent, a residual crosslinking agent, and a polymer binder composition consisting essentially of:

(1) a water-dispersible acrylic polymer comprising chemically reacted or chemically non-reacted hydroxyl, phospho, phosphonate, sulfo, sulfonate, carboxy, or carboxylate groups, and (2) a water-dispersible polyester that has a $T_g$ of 30° C. or less, wherein the water-dispersible acrylic polymer is present in an amount of at least 55 weight % of the resulting total dry image receiving layer weight, and is present in the polymeric binder matrix at a dry ratio to the water-dispersible polyester of at least 1:1 to and including 6:1, and drying the aqueous image receiving layer formulation to form a dry image receiving layer on one or both opposing sides of the support.

14. A method for making a thermal image, comprising:

imagewise transferring a clear polymeric film, one or more a dye images, or both a clear polymeric film and one or more dye images, from a thermal donor element to the image receiving layer of the dry thermal image receiving element of claim 1.

* * * * *